US006129445A

United States Patent [19]

Landy

[11] Patent Number: 6,129,445

[45] Date of Patent: Oct. 10, 2000

[54] SHOCK ABSORBING WORK LAMP PROTECTOR

[75] Inventor: Richard Landy, Castaic, Calif.

[73] Assignee: Yus United Enterprises Inc., Hsin Chuang, Taiwan

[21] Appl. No.: 09/132,054

[22] Filed: Aug. 11, 1998

[51] Int. Cl.[7] ..... F21V 15/04

[52] U.S. Cl. ..... 362/369; 362/390

[58] Field of Search ..... 362/369, 390, 362/368

[56] References Cited

U.S. PATENT DOCUMENTS

| | | | |
|---|---|---|---|
| 1,536,407 | 5/1925 | Pettus | 362/369 |
| 1,555,902 | 10/1925 | Brady | 362/369 |
| 1,643,925 | 9/1927 | Cooke, Jr. | 362/369 |
| 1,786,758 | 12/1930 | Larson | 362/369 |
| 1,874,271 | 8/1932 | Fracker | 362/369 |
| 1,948,690 | 2/1934 | Yost | 362/369 |
| 3,067,326 | 12/1962 | Knapp | 362/369 |
| 3,300,636 | 1/1967 | Quelland et al. | 362/369 |
| 4,482,125 | 11/1984 | Ziernicki | 362/369 |

*Primary Examiner*—Thomas M. Sember
*Attorney, Agent, or Firm*—Bacon & Thomas, PLLC

[57] ABSTRACT

A shock absorbing protector for work lamp mainly includes a polygonal protective framework defining an inner space and two sets of shock absorbing means separately provided at two ends of said protective framework. Each set of the shock absorbing means includes a central member and a plurality of elastic members radially and elastically extended from said central member. The central members are fixed two sides of a work lamp positioned inside the polygonal protective framework and the elastic members are connected at their outer ends to two end frames of the polygonal protective framework, making the work lamp suspended in the protective framework while a buffer distance is left between the work lamp and the protective framework. The polygonal protective framework and the shock absorbing elastic members protect the work lamp therein from tilting over or crushed while allow the work lamp to emit light at any angle of elevation.

3 Claims, 3 Drawing Sheets

SHOCK ABSORBING WORK LAMP PROTECTOR

FIELD OF THE INVENTION

The present invention relates to a shock absorbing work lamp protector, and more particularly to a shock absorbing work lamp protector which is impact-proof and can be stably seated on any surface to allow the work lamp to emit light at any angle of elevation.

BACKGROUND OF THE INVENTION

A conventional work lamp usually includes a housing in which electrical components are mounted, a lamp mounted to a front side of the housing, a wire box fixed to the work lamp, and a glass shade mounted on the housing in front of the lamp to cover and protect the lamp. Such conventional work lamp tends to tilt over or fall when it is in use, causing broken or damaged housing and/or glass shade.

There is a wire netting protector developed for covering over the glass shade of the conventional work lamp. Such wire netting protector works to protect the glass shade and the lamp but not the housing of the lamp. In the event the whole work lamp falls from a high position, the housing thereof is still subject to breaking or damage. Since the housing of the conventional work lamp is not designed to absorb shock, the lamp and the electrical components inside the housing of a fallen work lamp tend to be undesirably displaced and cause failure of the work lamp.

It is therefore tried by the inventor to develop an improved work lamp protector to eliminate the drawbacks existing in the conventional work lamp.

SUMMARY OF THE INVENTION

A primary object of the present invention is to provide a shock absorbing protector that includes a polygonal framework defining an inner space for accommodating a work lamp therein and two sets of shock absorbing means provided at two end frames of the framework to hold the work lamp in place, so that the work lamp is elastically suspended in the polygonal framework with a safe buffer distance left between the work lamp and the framework. When the work lamp accidentally tilts over or falls, the polygonal framework and the shock absorbing means together protect the lamp from becoming broken or damaged. The polygonal framework also allows the work lamp to stably seat on any surface and to conveniently emit fight at any angle of elevation.

BRIEF DESCRIPTION OF THE DRAWINGS

The above and other objects as well as the structural and functional features of the present invention can be best understood by referring to the following detailed description of the preferred embodiments and the accompanying drawings, wherein.

DETAILED DESCRIPTION OF THE PREFERRED EMBODIMENTS

Figure 1:
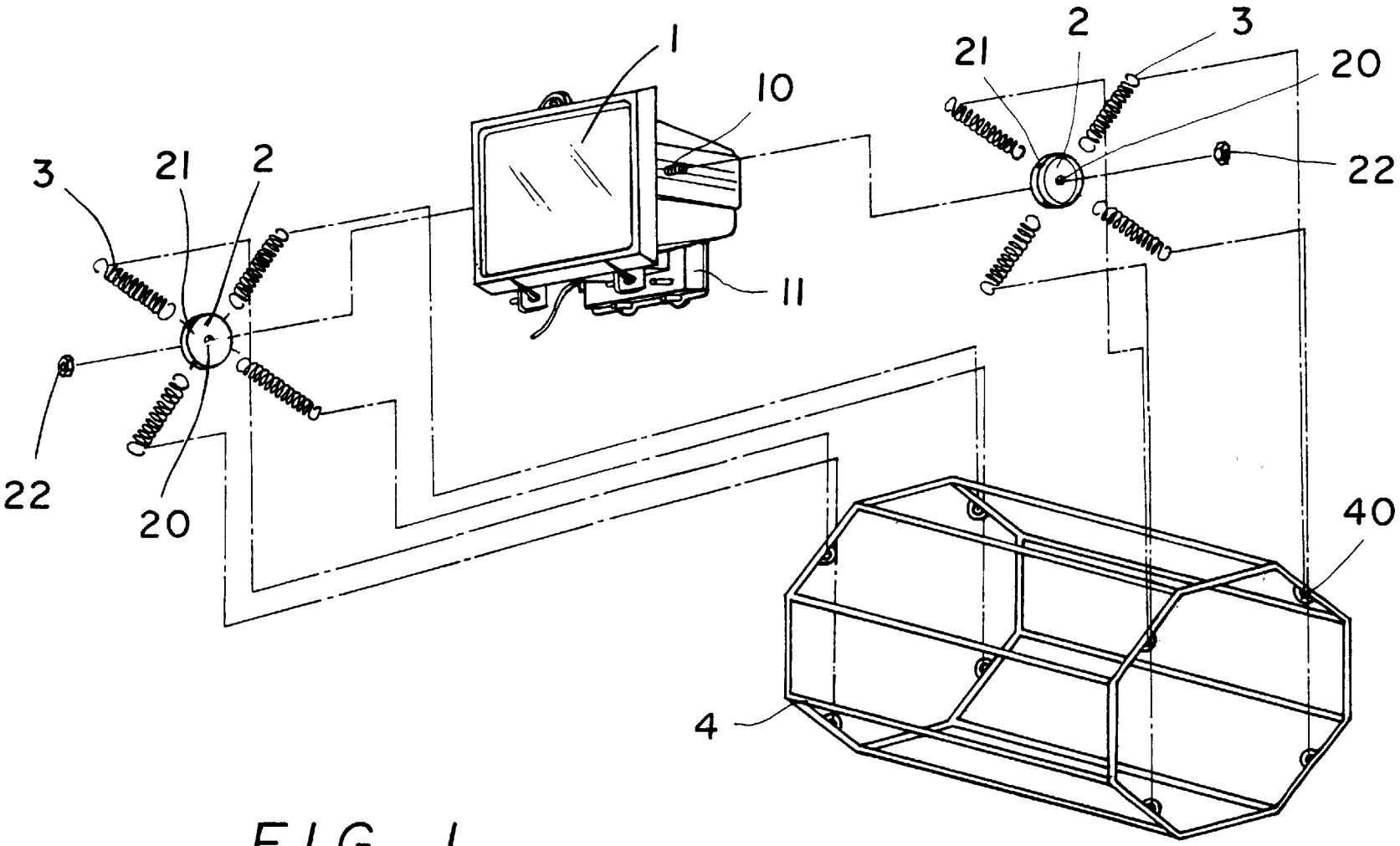
FIG. 1 is an exploded perspective of a shock absorbing work lamp protector according to the present invention.
Figure 2:
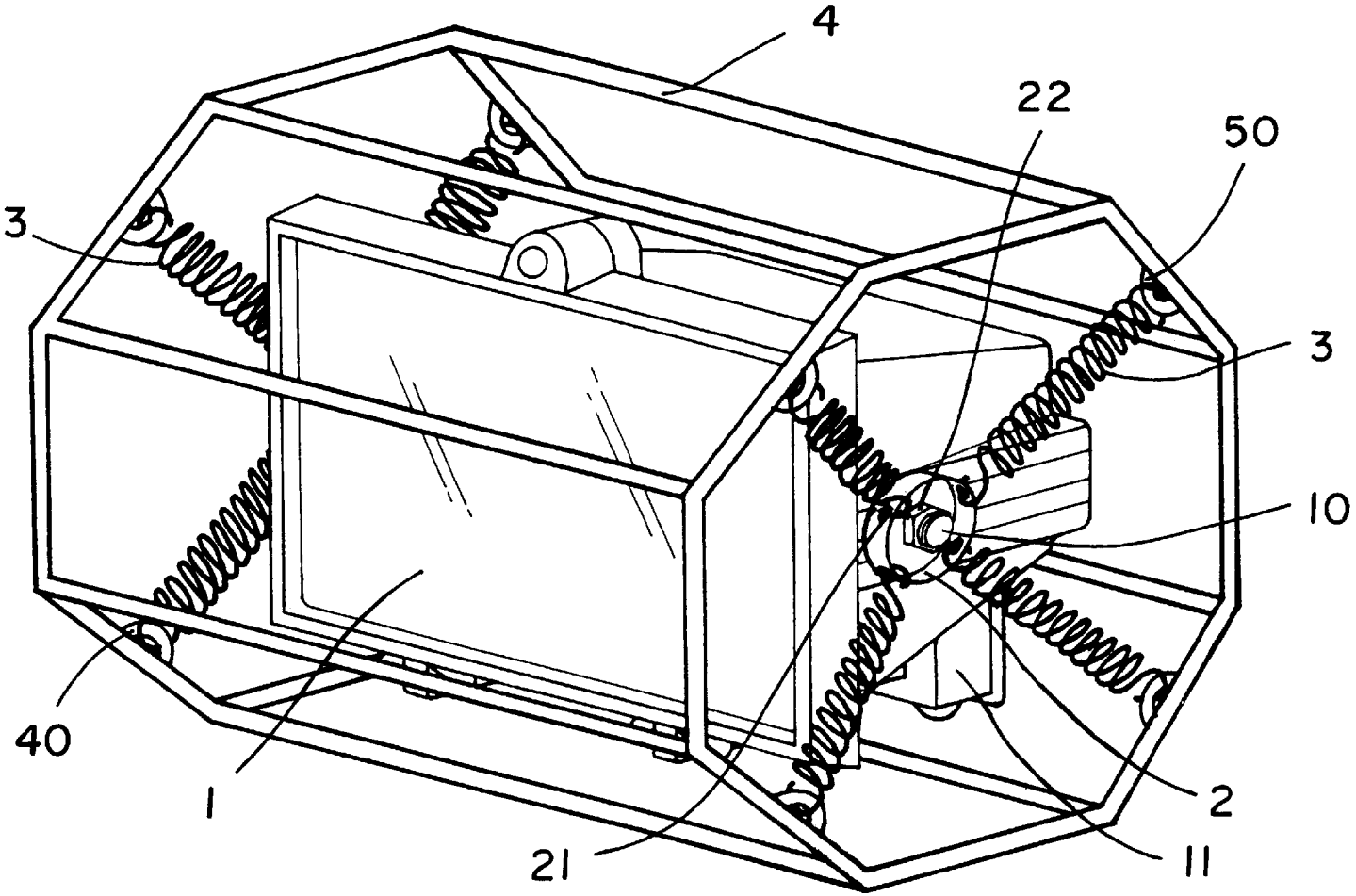
FIG. 2 is an assembled perspective of the work lamp protector of FIG. 1.

Please refer to FIGS. 1 and 2. The present invention relates to a shock absorbing work lamp protector that mainly includes a polygonal and hollow protective framework 4 defining an inner space for accommodating a work lamp 1 therein, and two sets of shock absorbing means separately provided at two ends of the protective framework 4.

The work lamp 1 is provided at a suitable position with a wire box 11 for receiving an electric wire therein when the work lamp 1 is not in use. Two screws 10 symmetrically project from suitable points at two lateral sides of a housing of the work lamp 1.

Each set of the shock absorbing means include a disc-shaped central member 2 and a plurality of (four are shown in the drawings) elastic members 3 radially extended from the central member 2. The central member 2 each has a centered through hole 20 through which the screw 10 on the work lamp 1 can extend to engage with a fastening means 22, so that the disc-shaped central member 2 is fixed to one side of the work lamp 1. A plurality of (four are shown in the drawings) holes 21 are equally spaced around a periphery of the central member 2. The elastic members 3 are connected at one end to the central member 2 by hooking their respective one end at the holes 21.

The protective framework 4 includes two symmetrical polygonal end frames and a plurality of straight bars extending between the two end frames to interconnect the same, so that the end frames and the straight bars together define an inner space and two planes defined by the two end frames are generally parallel to each other. Retaining rings 40 are spaced along inner peripheries of the two polygonal end frames to inward project therefrom toward one another. The elastic members 3 are connected at another end to the protective framework 4 by hooking their respective another end at the retaining rings 40 on the end frames.

Please refer to FIG. 2. After the central members 2 are screwed to two sides of the work lamp 1 with the elastic members 3 connected to and extended between the holes 21 and the retaining rings 40, the work lamp 1 is suspended in a general central portion of the inner space defined by the protective framework 4 by means of the shock absorbing means. At this point, all the elastic members 3 are in an elastically stretched state and keep all sides of the suspended work lamp 1 away from the protective framework 4 at a suitable buffer distance. If the work lamp 1 accidentally tilts over or fall, this buffer distance may prevent the work lamp 1 from impacting on the protective framework 4 or an external surface and becoming damaged. The fastening means 22 may be nuts or other similar means for engaging with the screws 10 (not shown in FIG. 2).

FIG. 2 illustrates a general manner for placement of the present invention. The polygonal protective framework 4 prevents it and the work lamp 1 suspended therein from easily rolling when the protective framework 4 is accidentally tilted over. Moreover, the polygon protective framework 4 allows easy adjustment of the work lamp 1 to emit light at different angle of elevation. The protective framework 4 tends to always hold the work lamp 1 in a balanced position even when the protective framework 4 is laid on an irregular surface. A further advantage of the present invention is the buffer distance between the work lamp 1 and the protective frame 4 defined by the elastic members 3 allows air to exist between the lamp and the protector. The air isolates heat emitted by the work lamp 1 from people or combustible material close to the work lamp 1 to avoid possible accidents of burn or fire.

Figure 3:
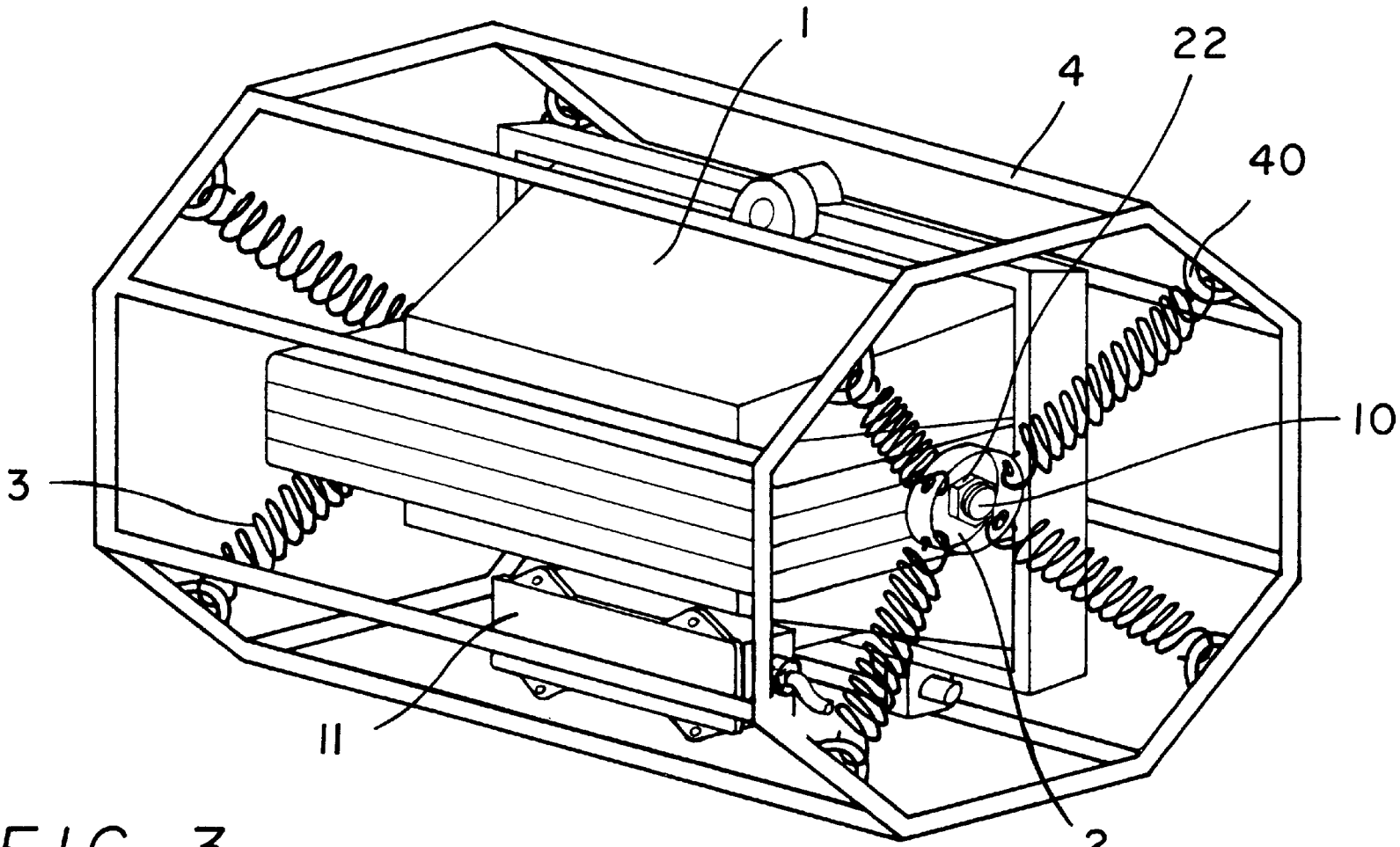
FIG. 3 is a rear perspective view of the work lamp protector of FIG. 2.

FIG. 3 is another perspective showing the present invention with a work lamp suspended therein as viewed from a rear side of the work lamp.

With the above arrangements, the shock absorbing protector of the present invention is novel and effectively improves the conventional work lamp to allow longer usable life thereof. The work lamp protector of the present invention absorbs shock and can be stably seated on any surface while it allows the work lamp therein to conveniently emit light at any angle of elevation.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A shock absorbing protector for work lamp, comprising:

a protective framework formed from two polygonal end frames and a plurality of straight bars extending between said two end frames to interconnect said end frames, such that said end frames and said straight bars together define an inner space for accommodating said work lamp therein, and that said two end frames define two generally parallel planes; and two sets of shock absorbing means each of which being provided at one of two ends of said protective framework and including a disc-shaped central member and a plurality of elastic members radially extended from said central member, each said central member being fixed to one side wall of said work lamp by engaging a fastening means with a screw extending from said one side wall of said work lamp and through a central hole on said central member, and said elastic members radially extended from said central member being connected at one end to said central member and at another end to one said end frame facing said central member; whereby said elastic members elastically stretch to cause said work lamp suspended inside said protective framework with a buffer distance left between said work lamp and said protective framework.

2. A shock absorbing protector for work lamp as claimed in claim 1, wherein said central member of each said shock absorbing means is provided along a periphery thereof with a plurality of through holes to which one end of said elastic members are hooked.

3. A shock absorbing protector for work lamp as claimed in claim 1, wherein said end frames of said protective framework are provided along inner peripheries with a plurality of retaining rings to which another end of said elastic members are hooked.

* * * * *